US011591922B2

(12) United States Patent
Jang et al.

(10) Patent No.: US 11,591,922 B2
(45) Date of Patent: Feb. 28, 2023

(54) RING SEGMENT AND GAS TURBINE INCLUDING THE SAME

(71) Applicant: DOOSAN ENERBILITY CO., LTD, Changwon (KR)

(72) Inventors: Yun Chang Jang, Gimhae (KR); Andrey Sedlov, Wurenlos (CH); Thomas Kotteck, Baden (CH)

(73) Assignee: DOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 17/727,729

(22) Filed: Apr. 23, 2022

(65) Prior Publication Data

US 2022/0243603 A1 Aug. 4, 2022

Related U.S. Application Data

(63) Continuation of application No. 17/169,208, filed on Feb. 5, 2021, now Pat. No. 11,339,677.

(30) Foreign Application Priority Data

Feb. 11, 2020 (KR) ..... 10-2020-0016565

(51) Int. Cl.

| | |
|---|---|
| ***F01D 11/08*** | (2006.01) |
| ***F01D 25/12*** | (2006.01) |
| *F01D 25/24* | (2006.01) |
| *F01D 9/04* | (2006.01) |

(52) U.S. Cl.

CPC ..... *F01D 11/08* (2013.01); *F01D 25/12* (2013.01); *F01D 9/041* (2013.01); *F01D 25/246* (2013.01); *F05D 2240/11* (2013.01); *F05D 2240/14* (2013.01); *F05D 2240/35* (2013.01); *F05D 2260/201* (2013.01); *F05D 2260/202* (2013.01)

(58) Field of Classification Search

CPC ..... F01D 11/08; F01D 25/246; F01D 25/12; F05D 2240/11; F05D 2260/20

See application file for complete search history.

(56) References Cited

U.S. PATENT DOCUMENTS

| | | | | |
|---|---|---|---|---|
| 7,033,138 | B2 * | 4/2006 | Tomita | F01D 25/12 415/173.1 |
| 7,517,189 | B2 * | 4/2009 | Camus | F01D 9/04 415/173.1 |
| 7,670,108 | B2 * | 3/2010 | Liang | F01D 11/008 415/173.1 |

(Continued)

*Primary Examiner* — Eldon T Brockman

(74) *Attorney, Agent, or Firm* — Harvest IP Law LLP

(57) ABSTRACT

A ring segment having improved cooling efficiency is provided. The ring segment may include a shield plate mounted to a casing which accommodates a turbine and configured to face an inner wall of the casing, a pair of hooks configured to protrude from the shield plate toward the casing to be coupled to the casing, a cavity defined between the shield plate and the pair of hooks, a plurality of first cooling passages configured to connect the cavity and first side surfaces facing each other of the shield plate, and a plurality of second cooling passages configured to connect the cavity and second side surfaces facing each other of the shield plate, wherein the first cooling passages extend in a longitudinal direction of a central axis of the turbine, and the second cooling passages extend in a circumferential direction of the turbine.

20 Claims, 7 Drawing Sheets

(56) References Cited

U.S. PATENT DOCUMENTS

| | | | | |
|---|---|---|---|---|
| 8,388,300 | B1 * | 3/2013 | Liang | F01D 11/08 415/173.1 |
| 11,421,550 | B2 * | 8/2022 | Jang | F01D 9/04 |
| 2004/0047725 | A1 * | 3/2004 | Tomita | F01D 11/08 415/173.1 |
| 2007/0041827 | A1 * | 2/2007 | Camus | F01D 25/12 415/116 |

* cited by examiner

[FIG. 1]
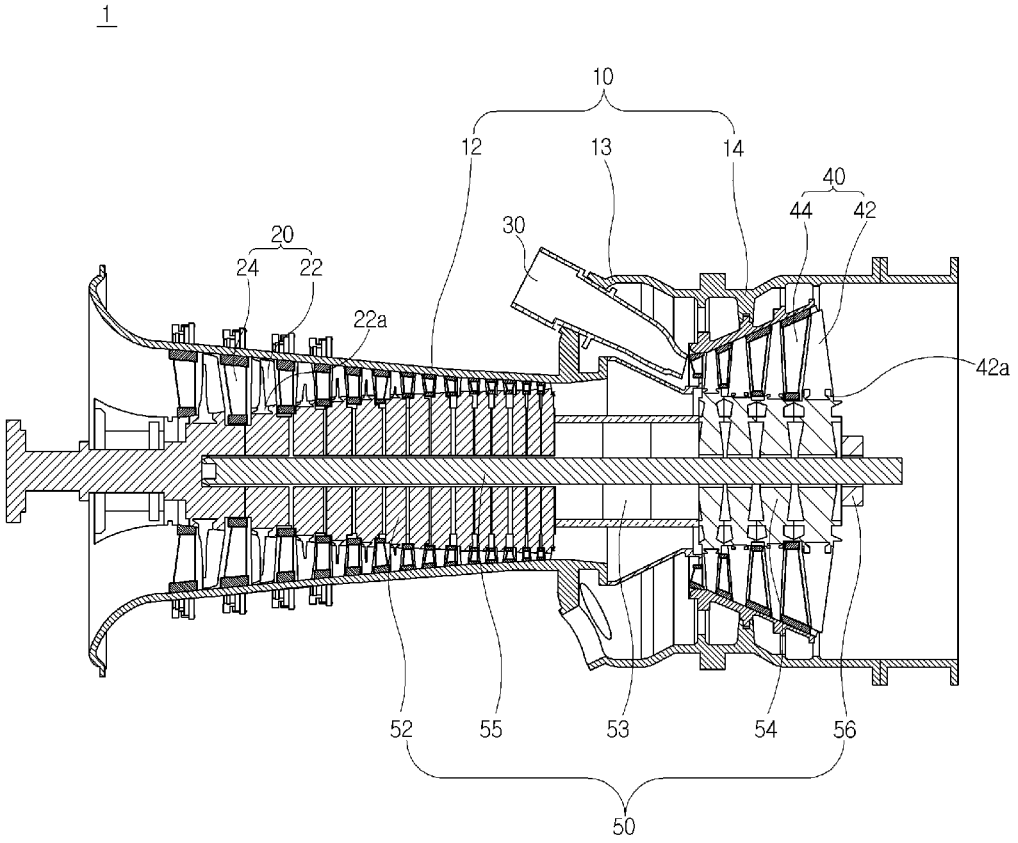

[FIG. 2]
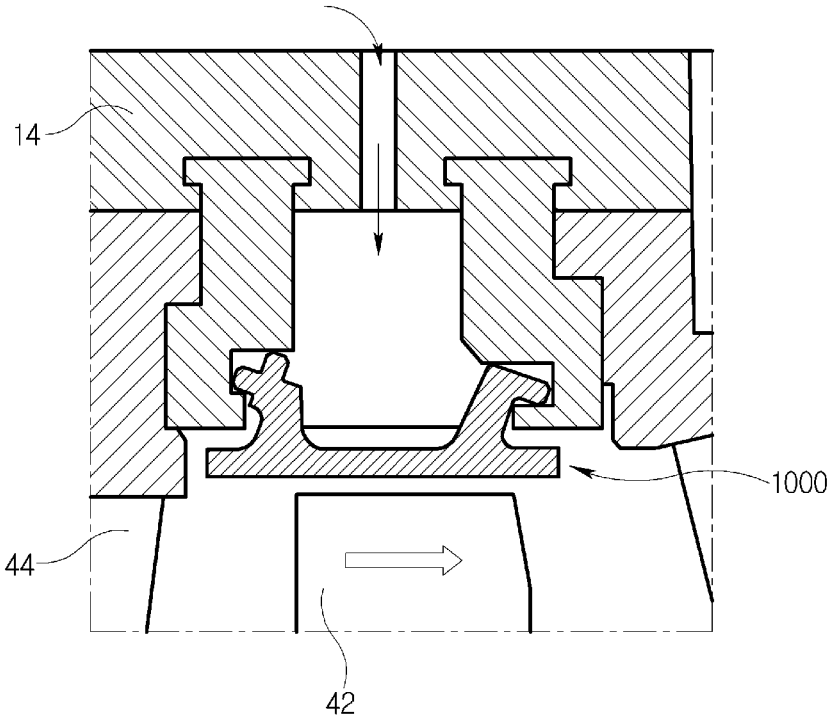

[FIG. 3]
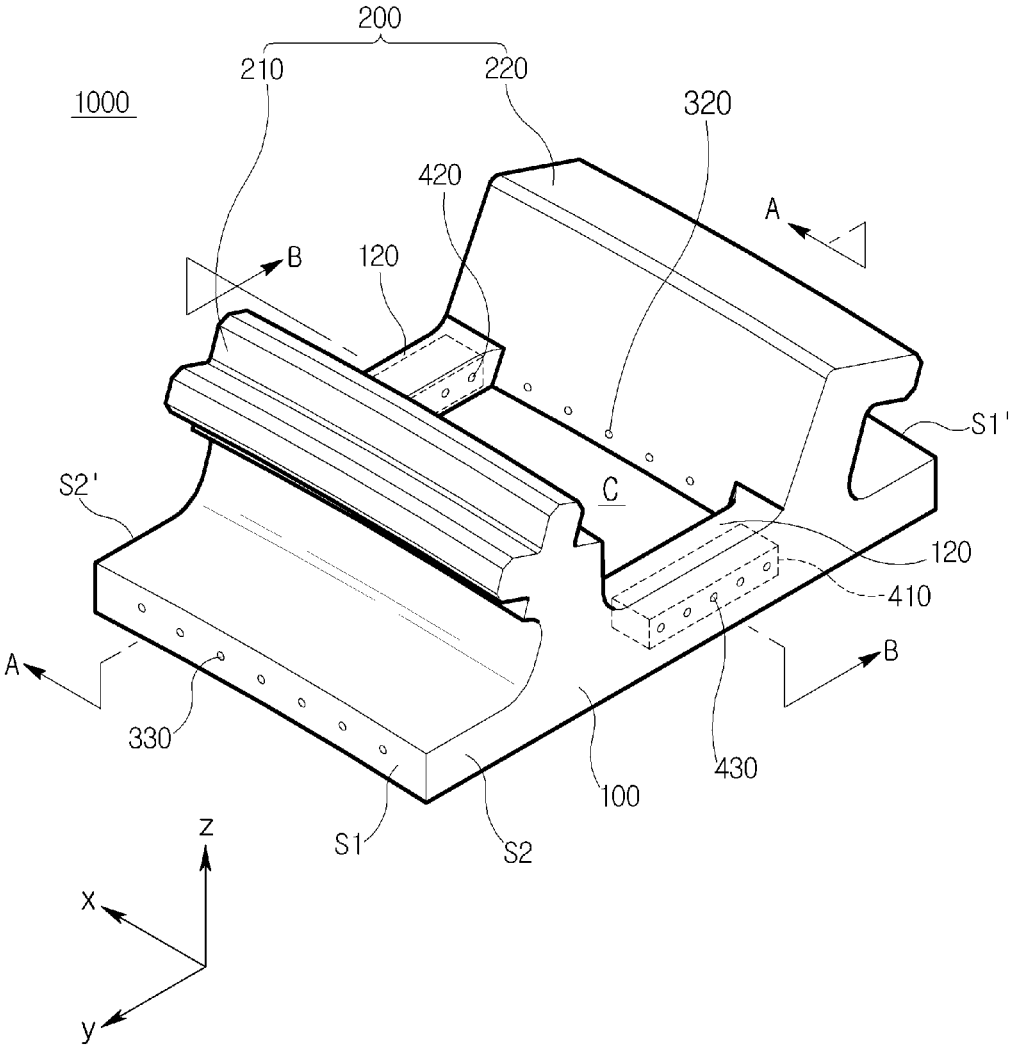

[FIG. 4]
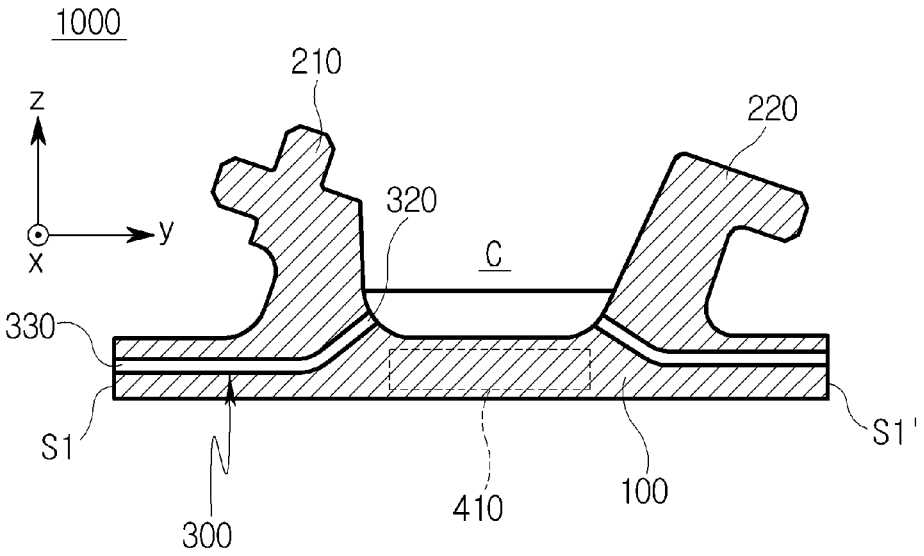
[FIG. 5]
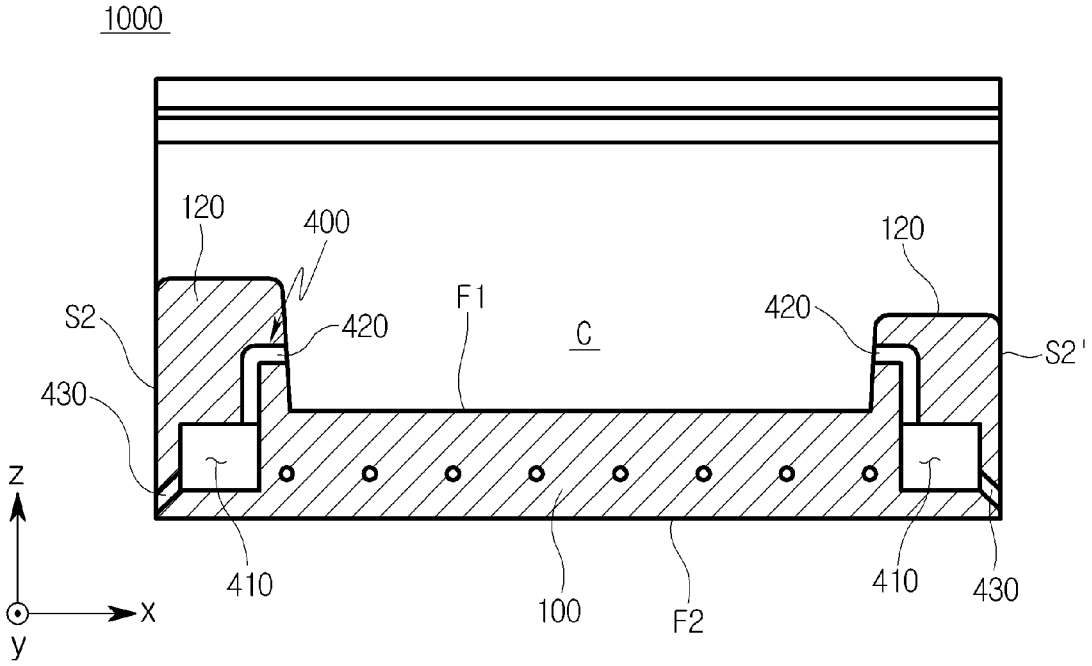

[FIG. 6]
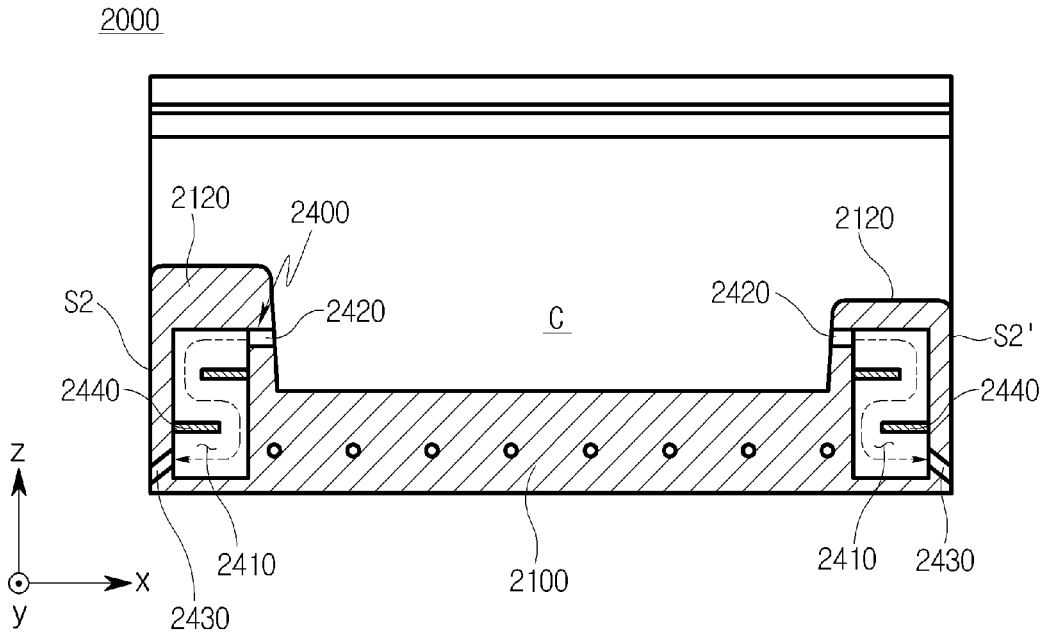
[FIG. 7]
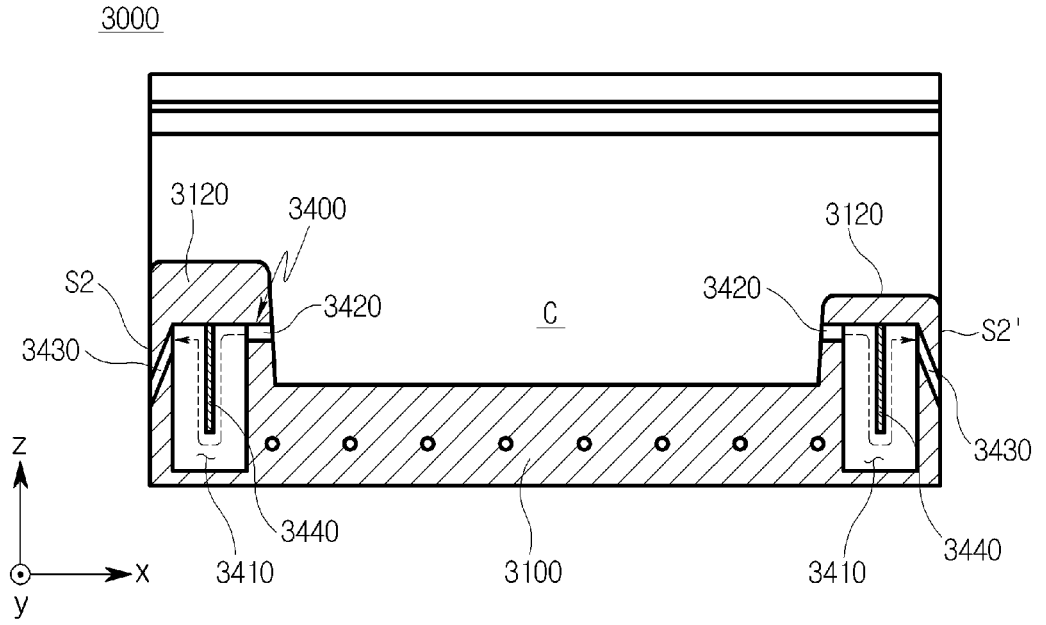

[FIG. 8]
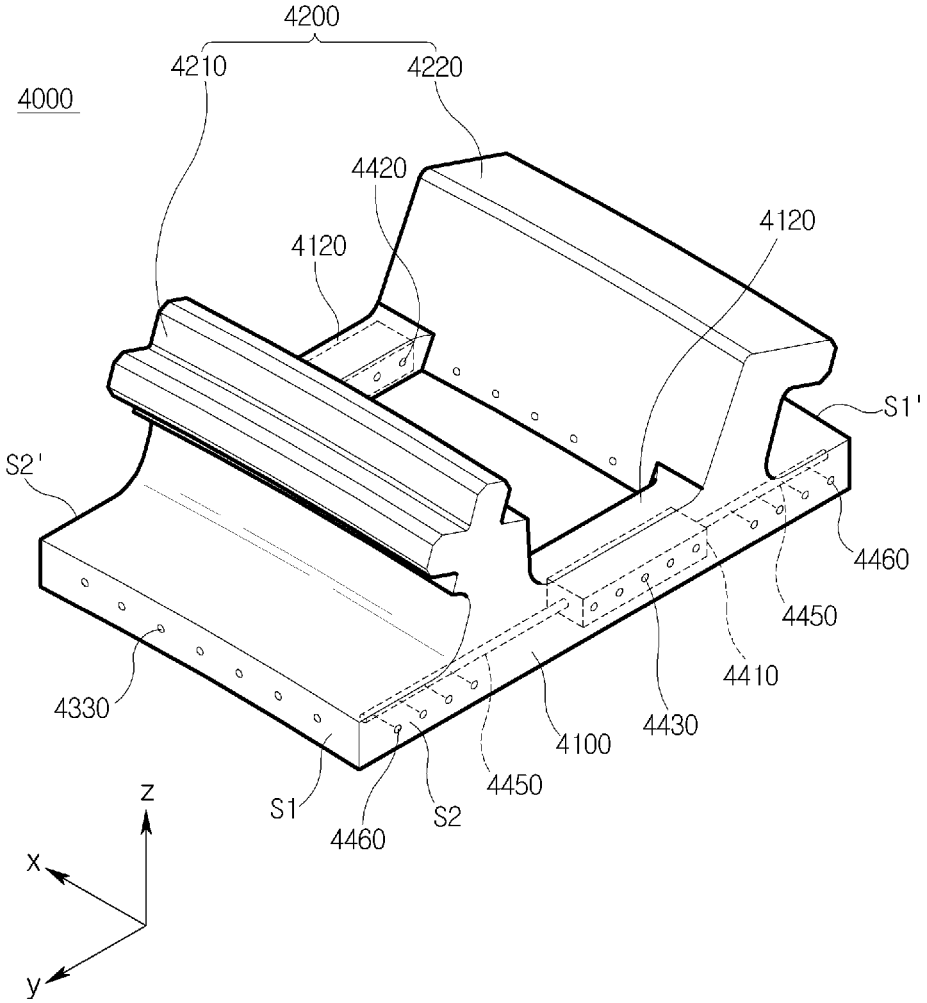

[FIG. 9]
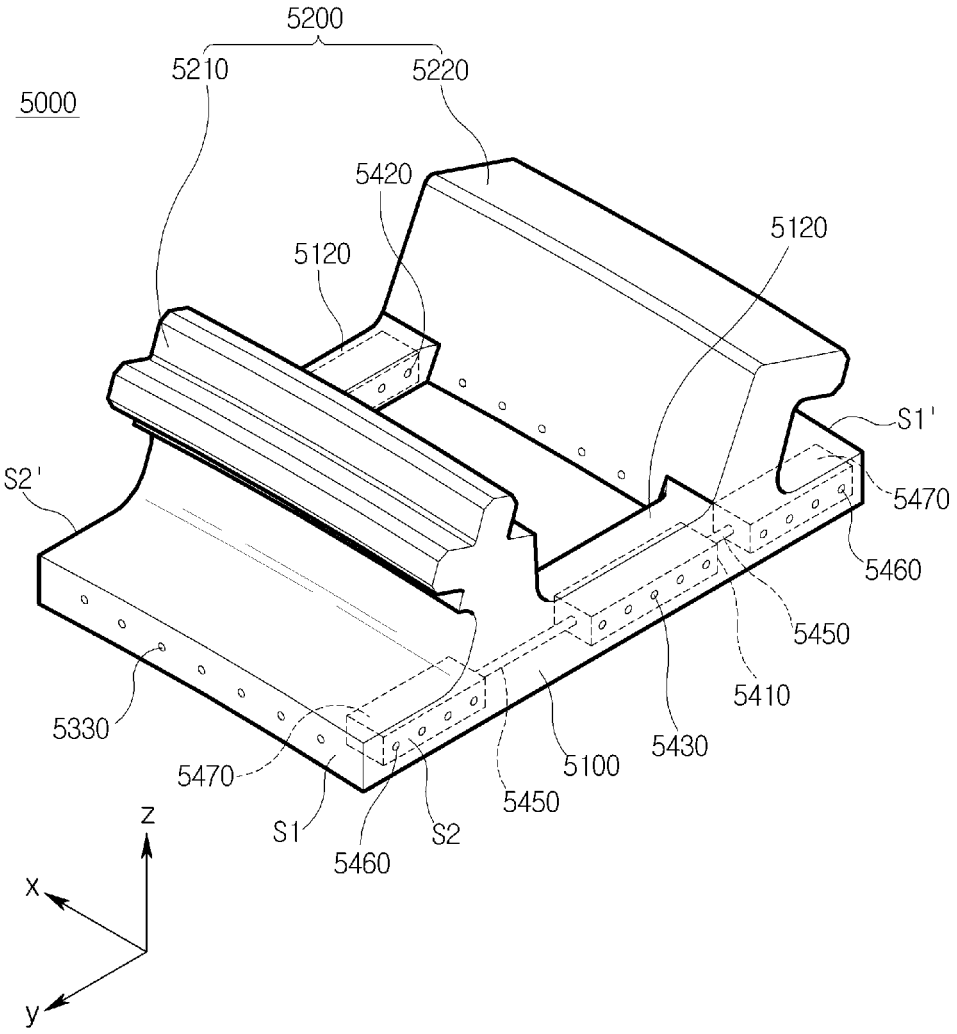

RING SEGMENT AND GAS TURBINE INCLUDING THE SAME

CROSS-REFERENCE TO RELATED APPLICATION

This is a Continuation of U.S. application Ser. No. 17/169,208 filed Feb. 5, 2021 which claims priority to Korean Patent Application No. 10-2020-0016565, filed on Feb. 11, 2020, the disclosure of which is incorporated herein by reference in its entirety.

BACKGROUND

Technical Field

Apparatuses and methods consistent with exemplary embodiments relate to a ring segment and a gas turbine including the same, and more particularly, to a ring segment capable of having improved cooling efficiency and efficiently preventing leakage of high-temperature and high-pressure combustion gas in a turbine, and a gas turbine including the same.

Description of the Related Art

Turbines are machines that convert the energy of a fluid, such as water, gas, or steam, into mechanical work, and are referred to as turbo machines in which a plurality of buckets or blades are mounted to a circumference of each rotor and steam or gas is emitted thereto to rotate the rotor at high speed by impingement or reaction force.

Examples of these turbines include a water turbine using the energy of high-positioned water, a steam turbine using the energy of steam, an air turbine using the energy of high-pressure compressed air, a gas turbine using the energy of high-temperature and high-pressure gas, and the like.

The gas turbine is a type of internal combustion engine that converts thermal energy into mechanical energy to rotate a turbine by injecting high-temperature and high-pressure combustion gas produced by mixing fuel with compressed air r and by burning a mixture thereof. The gas turbine is used to drive a generator, an aircraft, a ship, a train, etc.

The gas turbine has advantages in that consumption of lubricant is extremely low due to an absence of mutual friction parts such as a piston-cylinder because it does not have a reciprocating mechanism such as a piston in a four-stroke engine, and an amplitude of vibration is greatly reduced. Therefore, high-speed motion is possible.

The gas turbine includes a compressor that compresses air, a combustor that burns a mixture of fuel and the compressed air supplied from the compressor to produce combustion gas, and a turbine that generates electric power by rotating blades through the high-temperature and high-pressure combustion gas emitted from the combustor. The combustion gas injected into the turbine generates rotational force while passing through turbine vanes and turbine blades, thereby rotating a rotor of the turbine.

Ring segments are installed in the turbine to prevent a leakage of the high-temperature and high-pressure combustion gas which rotates the rotor and consequently enhances the efficiency of the gas turbine. The ring segments are installed in a turbine casing that accommodates the turbine blades and are positioned to surround an outer peripheries of the turbine blades. In this case, one surface of respective ring segments facing an internal space of the turbine casing may be exposed to high-temperature and high-pressure combustion gas to generate high thermal load, and the ring segment may be damaged by the thermal load. The ring segment includes a plurality of cooling passages to prevent damage due to the thermal load, and research and development of a cooling structure that improves cooling efficiency to prevent damage due to the thermal load is conducted continuously.

SUMMARY

Aspects of one or more exemplary embodiments provide a ring segment having improved cooling efficiency and efficiently preventing leakage of high-temperature and high-pressure combustion gas in a turbine, and a gas turbine including the same.

Additional aspects will be set forth in part in the description which follows and, in part, will become apparent from the description, or may be learned by practice of the exemplary embodiments.

According to an aspect of an exemplary embodiment, there is provided a ring segment including: a shield plate mounted to a casing which accommodates a turbine and configured to face an inner wall of the casing, a pair of hooks configured to protrude from the shield plate toward the casing to be coupled to the casing, a cavity defined between the shield plate and the pair of hooks, a plurality of first cooling passages configured to connect the cavity and first side surfaces facing each other of the shield plate, and a plurality of second cooling passages configured to connect the cavity and second side surfaces facing each other of the shield plate, wherein the first cooling passages extend in a longitudinal direction of a central axis of the turbine, and the second cooling passages extend in a circumferential direction of the turbine.

The shield plate may include chambers defined therein, and each of the second cooling passages may include an inlet connected to an associated one of the chambers from the cavity and an outlet connected to an associated one of the second side surfaces of the shield plate from the associated chamber.

The chambers may extend in the longitudinal direction of the central axis of the turbine between the pair of hooks.

The outlet may be inclined radially inward of the turbine.

The outlet may be inclined at an angle of 20° to 60°.

The chambers may be formed in respective second side ends facing each other of the shield plate.

The ring segment may further include a pair of reinforcing parts configured to protrude from the shield plate to connect the pair of hooks. The inlet may be formed in an inner surface of each of the reinforcing parts, and the outlet may be formed in each of the second side surfaces of the shield plate.

The ring segment may further include a plurality of additional cooling passages configured to be connected to both ends of each of the chambers and extend in the longitudinal direction of the central axis of the turbine.

The ring segment may further include a plurality of additional outlets configured to connect each of the additional cooling passages and an associated one of the second side surfaces of the shield plate.

The additional outlets may be spaced apart from each other in the longitudinal direction of the central axis of the turbine, and may be arranged in a portion excluding portions in which the pair of hooks are formed in the shield plate.

Each of the additional cooling passages may be connected to an additional chamber.

The ring segment may further include a plurality of additional outlets configured to connect the additional chamber and an associated one of the second side surfaces of the shield plate.

The additional chamber may be formed in a portion excluding portions in which the pair of hooks are formed in the shield plate.

The outlets formed in one of the facing second side surfaces of the shield plate and the outlets formed in the other of the facing second side surfaces may be arranged in a staggered form.

A number of outlets formed in one surface, positioned forward in a rotational direction of the turbine, of the facing second side surfaces of the shield plate may be greater than a number of outlets formed in the other surface, positioned rearward in the rotational direction of the turbine, of the facing second side surfaces.

Each of the chambers may be provided therein with a partition wall having one end fixed to an upper inner surface of the chamber, and the inlet and the outlet may be connected to an upper side of the chamber.

According to an aspect of another exemplary embodiment, there is provided a turbine including: a turbine casing, a rotatable turbine rotor disk disposed in the turbine casing, a plurality of turbine blades installed on the turbine rotor disk, a plurality of turbine vanes installed in the turbine casing, and a plurality of ring segments mounted to the turbine casing to surround the turbine blades, wherein the ring segments are arranged adjacently and continuously in a circumferential direction of the turbine casing to form a ring shape. Each of the ring segments includes a shield plate configured to face an inner wall of the turbine casing, a pair of hooks configured to protrude from the shield plate toward the turbine casing to be coupled to the turbine casing, a cavity defined between the shield plate and the pair of hooks, a plurality of first cooling passages configured to connect the cavity and first side surfaces facing each other of the shield plate, and a plurality of second cooling passages configured to connect the cavity and second side surfaces facing each other of the shield plate. The first side surfaces face the turbine vanes, and the second side surfaces face adjacent ring segments.

Cooling air sprayed from one ring segment may be offset from cooling air sprayed theretoward from an adjacent ring segment.

In each of the ring segments, an amount of cooling air discharged from a second side surface positioned forward in a rotational direction of the turbine blades may be greater than an amount of cooling air discharged from a second side surface positioned rearward in the rotational direction of the turbine blades.

According to an aspect of another exemplary embodiment, there is provided a gas turbine including: a compressor configured to compress air introduced from an outside, a combustor configured to mix fuel with the air compressed by the compressor and burn a mixture thereof to produce high-temperature and high-pressure combustion gas, a turbine configured to generate a rotational force using the combustion gas discharged from the combustor, and a casing in which the compressor, the combustor, and the turbine are accommodated. The turbine may include a rotatable turbine rotor disk disposed in the casing, a plurality of turbine blades installed on the turbine rotor disk, a plurality of turbine vanes installed in the casing, and a plurality of ring segments mounted to the casing to surround the turbine blades, and the ring segments are arranged adjacently and continuously in a circumferential direction of the casing to form a ring shape. Each of the ring segments may include a shield plate configured to face an inner wall of the casing, a pair of hooks configured to protrude from the shield plate toward the casing to be coupled to the casing, a cavity defined between the shield plate and the pair of hooks, a plurality of first cooling passages configured to connect the cavity and first side surfaces facing each other of the shield plate, and a plurality of second cooling passages configured to connect the cavity and second side surfaces facing each other of the shield plate. The first side surfaces face the turbine vanes, and the second side surfaces face adjacent ring segments.

BRIEF DESCRIPTION OF THE DRAWINGS

The above and other aspects will become more apparent from the following description of the exemplary embodiments with reference to the accompanying drawings, in which:

FIG. 1 is a cross-sectional view illustrating a gas turbine according to an exemplary embodiment;

FIG. 2 is an enlarged cross-sectional view illustrating a portion of a turbine casing in which a ring segment according to a first exemplary embodiment is installed in the gas turbine of FIG. 1;

FIG. 3 is a perspective view illustrating the ring segment separated from FIG. 2;

FIG. 4 is a cross-sectional view taken along line A-A of FIG. 3;

FIG. 5 is a cross-sectional view taken along line B-B of FIG. 3;

FIG. 6 is a cross-sectional view illustrating a ring segment according to a second exemplary embodiment;

FIG. 7 is a cross-sectional view illustrating a ring segment according to a third exemplary embodiment;

FIG. 8 is a perspective view illustrating a ring segment according to a fourth exemplary embodiment; and FIG. 9 is a perspective view illustrating a ring segment according to a fifth exemplary embodiment.

DETAILED DESCRIPTION

Various changes and various embodiments will be described in detail with reference to the drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the sprit and technical scope disclosed herein.

The terminology used herein is for the purpose of describing specific embodiments only, and is not intended to limit the scope of the disclosure. The singular expressions "a", "an", and "the" may include the plural expressions as well, unless the context clearly indicates otherwise. In the disclosure, the terms such as "comprise", "include", "have/has" should be construed as designating that there are such features, integers, steps, operations, components, parts, and/or combinations thereof, not to exclude the presence or possibility of adding one or more other features, integers, steps, operations, components, parts and/or combinations thereof.

Further, terms such as "first," "second," and so on may be used to describe a variety of elements, but the elements should not be limited by these terms. The terms are used simply to distinguish one element from other elements. The use of such ordinal numbers should not be construed as limiting the meaning of the term. For example, the components associated with such an ordinal number should not be limited in the order of use, placement order, or the like. If necessary, each ordinal number may be used interchangeably.

Hereinafter, a ring segment and a gas turbine including the same according to exemplary embodiments will be described with reference to the accompanying drawings. Reference now should be made to the drawings, in which the same reference numerals are used throughout the different drawings to designate the same or similar components. Details of well-known configurations and functions may be omitted to avoid unnecessarily obscuring the gist of the present disclosure. For the same reason, some components in the accompanying drawings are exaggerated, omitted, or schematically illustrated.

FIG. 1 is a cross-sectional view illustrating a gas turbine according to an exemplary embodiment. FIG. 2 is an enlarged cross-sectional view illustrating a portion of a turbine casing in which a ring segment according to a first exemplary embodiment is installed in the gas turbine of FIG. 1.

Referring to FIG. 1, the gas turbine 1 may include a casing 10, a compressor 20 that draws air from the outside and compresses the air to a high pressure, a combustor 30 that mixes fuel with the compressed air supplied from the compressor 20 and burns a mixture thereof, and a turbine 40 that generates a rotational force with the combustion gas discharged from the combustor 30 to generate electric power.

The casing 10 may include a compressor casing 12 for accommodating the compressor 20 therein, a combustor casing 13 for accommodating the combustor 30 therein, and a turbine casing 14 for accommodating the turbine 40 therein. Here, the compressor casing 12, the combustor casing 13, and the turbine casing 14 may be arranged sequentially from upstream to downstream in a flow direction of a fluid.

A rotor (i.e., center shaft) 50 may be rotatably provided in the casing 10, a generator may be connected to the rotor 50 for power generation, and a diffuser may be provided downstream in the casing 10 to discharge the combustion gas passing through the turbine 40.

The rotor 50 may include a compressor rotor disk 52 accommodated in the compressor casing 12, a turbine rotor disk 54 accommodated in the turbine casing 14, a torque tube 53 accommodated in the combustor casing 13 to connect the compressor rotor disk 52 and the turbine rotor disk 54, and a tie rod 55 and a fixing nut 56 that fasten the compressor rotor disk 52, the torque tube 53, and the turbine rotor disk 54.

The compressor rotor disk 52 may include a plurality of compressor rotor disks arranged in an axial direction of the rotor 50. That is, the compressor rotor disks 52 may be formed in a multistage manner. In addition, each of the compressor rotor disks 52 may have a substantially disk shape and have a compressor blade coupling slot formed in the outer peripheral portion thereof such that a compressor blade 22 is coupled to the compressor blade coupling slot.

The turbine rotor disk 54 may have a structure similar to the compressor rotor disk 52. That is, the turbine rotor disk 54 may include a plurality of turbine rotor disks arranged in the axial direction of the rotor 50. That is, the turbine rotor disks 54 may be formed in a multistage manner. In addition, each of the turbine rotor disks 54 may have a substantially disk shape and have a turbine blade coupling slot formed in the outer peripheral portion thereof such that a turbine blade 42 is coupled to the turbine blade coupling slot.

The torque tube 53 serving as a torque transmission member that transmits the rotational force generated from the turbine rotor disk 54 to the compressor rotor disk 52 is disposed between the compressor 20 and the turbine 40. One end of the torque tube 53 may be fastened to a most-downstream-side compressor rotor disk in a flow direction of air among the plurality of compressor rotor disks 52, and the other end of the torque tube 53 may be fastened to a most-upstream-side turbine rotor disk in a flow direction of combustion gas among the plurality of turbine rotor disks 54. Here, the torque tube 53 may have a protrusion formed at one end and the other end thereof, respectively, and each of the compressor rotor disk 52 and the turbine rotor disk 54 may have a groove coupled to the protrusion. Thus, it is possible to prevent the torque tube 53 from rotating relative to the compressor rotor disk 52 and the turbine rotor disk 54.

The torque tube 53 may have a hollow cylindrical shape such that the air supplied from the compressor 20 flows to the turbine 40 through the torque tube 53. Also, the torque tube 53 may be formed to resist deformation and distortion due to characteristics of the gas turbine that continues to operate for a long time, and may be easily assembled and disassembled to facilitate maintenance.

The tie rod 55 may pass through the plurality of compressor rotor disks 52, the torque tube 53, and the plurality of turbine rotor disks 54. One end of the tie rod 55 may be fastened to a most-upstream-side compressor rotor disk in a flow direction of air among the plurality of compressor rotor disks 52. The other end of the tie rod 55 may protrude in a direction opposite to the compressor 20 with respect to a most-downstream-side turbine rotor disk in a flow direction of flow of combustion gas among the plurality of turbine rotor disks 54 so as to be fastened to the fixing nut 56.

Here, the fixing nut 56 presses the most-downstream-side turbine rotor disk 54 toward the compressor 20 to reduce a distance between the most-upstream-side compressor rotor disk 52 and the most-downstream-side turbine rotor disk 54, resulting in the plurality of compressor rotor disks 52, the torque tube 53, and the plurality of turbine rotor disks 54 may be compressed in the axial direction of the rotor 50. Therefore, it is possible to prevent an axial movement and relative rotation of the plurality of compressor rotor disks 52, the torque tube 53, and the plurality of turbine rotor disks 54.

Although one tie rod is illustrated as passing through centers of the plurality of compressor rotor disks, the torque tube, and the plurality of turbine rotor disks in FIG. 1, it is understood that the present disclosure is not limited thereto and may be changed or vary according to one or more other exemplary embodiments. For example, a separate tie rod may be provided in each of the compressor and the turbine, a plurality of tie rods may be arranged circumferentially and radially, or a combination thereof may be used.

Through this configuration, both ends of the rotor 50 may be rotatably supported by bearings, and one end of the rotor 50 may be connected to the drive shaft of the generator.

The compressor 20 may include a compressor blade 22 that rotates together with the rotor 50, and a compressor vane 24 that is installed in the compressor casing 12 to align the flow of the air introduced into the compressor blade 22.

The compressor blade 22 may include a plurality of compressor blades arranged in a multistage manner in the axial direction of the rotor 50, and the plurality of compressor blades 22 may be formed radially in the direction of rotation of the rotor 50 for each stage.

Each of the compressor blades 22 may have a root 22*a* coupled to the compressor blade coupling slot of the compressor rotor disk 52. The root 22*a* may have a fir-tree shape to prevent the compressor blade 22 from being decoupled from the compressor blade coupling slot in the radial direction of the rotor 50. In this case, the compressor blade coupling slot may have a fir-tree shape to correspond to the root 22*a* of the compressor blade.

Although the compressor blade root 22*a* and the compressor blade coupling slot are illustrated as having the fir-tree shape in the exemplary embodiment, it is understood that the present disclosure is not limited thereto and may be changed or vary according to one or more other exemplary embodiments. For example, they may have a dovetail shape. In some cases, the compressor blade may be fastened to the compressor rotor disk by using other types of fastener, such as a key or a bolt.

Here, the compressor rotor disk 52 and the compressor blade 22 may be coupled to each other in a tangential type or axial type. In the exemplary embodiment, the compressor blade root 22*a* is inserted into the compressor blade coupling slot in the axial direction of the rotor 50 (i.e., in the axial type). Thus, the compressor blade coupling slot according to the exemplary embodiment may include a plurality of compressor blade coupling slots arranged radially in the circumferential direction of the compressor rotor disk 52.

The compressor vane 24 may include a plurality of compressor vanes arranged in a multistage manner in the axial direction of the rotor 50. Here, the compressor vanes 24 and the compressor blades 22 may be arranged alternately in the flow direction of air. In addition, the plurality of compressor vanes 24 may be formed radially in the direction of rotation of the rotor 50 for each stage. Here, at least some of the plurality of compressor vanes 24 may be rotatably mounted within a fixed range in order to regulate an inflow rate of air or the like.

The combustor 30 mixes fuel with the introduced compressed air and burns the fuel-air mixture to produce high-temperature and high-pressure combustion gas having high energy. The temperature of the combustion gas may be increased to a heat-resistant limit of the combustor and turbine through an isobaric combustion process.

A plurality of combustors constituting the combustor 30 may be arranged in the direction of rotation of the rotor 50 in the combustor casing in a form of a cell.

Each of the combustors 30 includes a liner into which the compressed air is introduced and a transition piece positioned behind the liner to guide the combustion gas to the turbine 40. The liner and the transition piece define a combustion chamber therein, and a sleeve is disposed to surround the liner and the transition piece so that an annular flow space is defined between the liner and transition piece and the sleeve.

In addition, the combustor 30 may include a fuel injection nozzle provided in front of the liner to inject fuel into the compressed air flowing out of the compressor for mixing them, and an ignition plug provided on a wall of the liner to ignite the mixture of compressed air and fuel mixed in the combustion chamber of the liner. The produced combustion gas is discharged to the turbine 40, resulting in a rotational force.

In this case, it is important to cool the liner and the transition piece, which are exposed to high-temperature and high-pressure combustion gas, in order to increase the durability of the combustor. To this end, the sleeve has cooling holes through which the compressed air can be injected while vertically impinging on outer walls of the liner and transition piece.

For example, the compressed air discharged from the compressor 20 may flow into the annular space through the cooling holes formed in the sleeve to cool the liner and transition piece, flow to the front of the liner along the annular space, and then flow toward the fuel injection nozzle.

In order to match a flow angle of air entering the combustor 30 to a design flow angle, a deswirler serving as a guide vane may be formed between the compressor 20 and the combustor 30.

The turbine 40 basically has a structure similar to that of the compressor 20. The turbine 40 may include a turbine blade 42 that rotates together with the rotor 50 and a turbine vane 44 that is fixedly installed in the turbine casing 14 to align the flow of the air introduced into the turbine blade 42.

The turbine blade 42 may include a plurality of turbine blades arranged in a multistage manner in the axial direction of the rotor 50, and the plurality of turbine blades 42 may be formed radially in the direction of rotation of the rotor 50 for each stage.

For example, each of the turbine blades 42 may include a plate-shaped turbine blade platform, a turbine blade root 42*a* extending centripetally in the radial direction of the rotor 50 from the turbine blade platform, and a turbine blade airfoil extending centrifugally in the radial direction of the rotor 50 from the turbine blade platform.

The turbine blade platform may contact an adjacent turbine blade platform which may serve to maintain a distance between adjacent turbine blade airfoils.

The root 42*a* of the turbine blade 42 may be coupled to the turbine blade coupling slot of the turbine rotor disk 54 and have a fir-tree shape to prevent the turbine blade 42 from being decoupled from the turbine blade coupling slot in the radial direction of the rotor 50. In this case, the turbine blade coupling slot may have a fir-tree shape to correspond to the root 42*a* of the turbine blade. The turbine blade root 42*a* may be inserted into the turbine blade coupling slot in the axial direction of the rotor 50 (i.e., in the axial type).

The turbine blade airfoil may be formed to have an optimized airfoil shape according to the specification of the gas turbine. The turbine blade airfoil may include a leading edge positioned upstream in the flow direction of combustion gas so that the combustion gas flows into the leading edge, and a trailing edge positioned downstream in the flow direction of combustion gas so that the combustion gas flows out of the trailing edge.

The turbine vane 44 may include a plurality of turbine vanes arranged in a multistage manner in the axial direction of the rotor 50. Here, the turbine vanes 44 and the turbine blades 42 may be arranged alternately in the flow direction of air. In addition, the plurality of turbine vanes 44 may be formed radially in the direction of rotation of the rotor 50 for each stage.

Because the turbine 40 comes into contact with high-temperature and high-pressure combustion gas, the turbine 40 requires a cooling device to prevent damage such as deterioration. To this end, the turbine may include a cooling passage through which some of the compressed air is drawn out from some portions of the compressor 20 and is supplied to the turbine 40.

The cooling passage may extend from the outside of the casing 10 (i.e., an external passage), or extend through the inside of the rotor 50 (i.e., an internal passage), or both of the external passage and the internal passage may be used.

In this case, the cooling passage may communicate with a turbine blade cooling passage defined in the turbine blade 42 to cool the turbine blade 42 with cooling air. The turbine blade cooling passage may communicate with a turbine blade film cooling hole formed in a surface of the turbine blade 42 to supply cooling air to the surface of the turbine blade 42, thereby enabling the turbine blade 42 to be cooled by the cooling air in a film cooling manner. The turbine vane 44 may also be cooled by the cooling air supplied from the cooling passage, similar to the turbine blade 42.

Meanwhile, the turbine 40 requires a clearance between an airfoil tip of the turbine blade 42 and an inner peripheral surface of the turbine casing 14 for smooth rotation of the turbine blade 42.

As the clearance increases, it is advantageous in preventing interference between the turbine blade 42 and the turbine casing 14, but is disadvantageous in the leakage of combustion gas. On the other hand, as the clearance decreases, it is the opposite. The flow of the combustion gas discharged from the combustor 30 may be divided into a main flow passing through the turbine blade 42 and a leakage flow passing through the clearance between the turbine blade 42 and the turbine casing 14. Accordingly, as the clearance increases, the leakage flow increases, which may lead to a deterioration in gas turbine efficiency, but interference between the turbine blade 42 and the turbine casing 14 may be prevented, thereby preventing damage due to thermal deformation or the like. On the other hand, as the clearance decreases, the leakage flow decreases, which may improve gas turbine efficiency, but it may cause interference between the turbine blade 42 and the turbine casing 14, which may be damaged by thermal deformation or the like.

Accordingly, in the gas turbine according to the exemplary embodiment, the turbine 40 includes a ring segment to secure adequate clearance between the turbine blade 42 and the turbine casing 14, which prevents interference and damage therebetween while minimizing a deterioration in gas turbine efficiency.

Referring to FIG. 2, the ring segment 1000 is installed in an inner peripheral surface of the turbine casing 14 to surround the turbine blade 42. For example, the ring segment 1000 may include a plurality of ring segments which are mounted in an inner wall of the turbine casing 14 and are continuously arranged in the circumferential direction (i.e., x-axis direction) of the turbine casing 14 to form a ring shape. The plurality of ring segments 1000 forming a ring shape surround the outer peripheries of the turbine blades 42 to prevent leakage of combustion gas. That is, the plurality of ring segments 1000 are formed in a multistage manner corresponding to positions of the turbine blades 42 in the longitudinal direction (i.e., y-axis direction) of a central axis of the turbine 40 and are arranged alternately with the turbine vanes 44.

In this case, because the high-temperature and high-pressure combustion gas passes through the turbine casing 14, the ring segments 1000, in particular the portions of the ring segments 1000 facing the inner space of the turbine casing 14 may be broken due to thermal load. Therefore, to prevent this breakage, each ring segments 1000 is provided with a plurality of cooling passages.

It is understood that the gas turbine is merely an example, and the ring segment of the exemplary embodiments may be widely applied to a jet engine in which a mixture of air and fuel is burned.

FIG. 3 is a perspective view illustrating the ring segment separated from FIG. 2, FIG. 4 is a cross-sectional view taken along line A-A of FIG. 3, and FIG. 5 is a cross-sectional view taken along line B-B of FIG. 3.

Referring to FIGS. 3 to 5, the ring segment 1000 includes a shield plate 100 that faces the inner wall of the turbine casing 14 and extends in the direction of rotation of the rotor 50, and a pair of hooks 200 that protrude toward the turbine casing 14 from the shield plate 100. The shield plate 100 may have a substantially square plate shape. The pair of hooks 200 are inserted into grooves formed in the turbine casing 14 by bending and protruding in the radial direction (i.e., z-axis direction) of the turbine 40 toward the turbine casing 14 from an outer surface of the shield plate 100. In the exemplary embodiment, the shield plate 100 and the pair of hooks 200 are integrally formed.

A cavity C is defined between the shield plate 100 and the pair of hooks 200. Cooling air is supplied through the turbine casing 14 to the cavity C to cool the ring segment 1000, as illustrated in FIG. 2. If a surface of the shield plate 100 facing the turbine casing 14 is referred to as a target surface F1 struck by cooling air, and a surface of the shield plate 100 facing an associated turbine blade 42 is referred to as a hot side surface F2, it is deemed that the cavity C is formed in the target surface F1. The cooling air may correspond to compressed air discharged from the compressor 20.

The ring segment 1000 includes reinforcing parts 120 which protrude from the shield plate 100 and lead from a first hook 210 to a second hook 220. For example, two reinforcing parts 120 may be formed in the shield plate 100, and protrude from both side ends of the shield plate 100 to connect the first hook 210 and the second hook 220. Accordingly, the first hook 210, the second hook 220, and the two reinforcing parts 120 may define the cavity C by surrounding them.

According to the exemplary embodiment, the ring segment 1000 is simultaneously provided with first cooling passages 300 that allow cooling air to be sprayed from the cavity C to first side surfaces S1 and S1' of the shield plate 100 facing each other, and second cooling passages 400 that allow cooling air to be sprayed from the cavity C to second side surfaces S2 and S2'of the shield plate 100 facing each other.

The first side surfaces S1 and S1' of the shield plate 100 are defined as side surfaces facing each other in the longitudinal direction (i.e., y-axis direction) of the central axis of the turbine 40, that is, side surfaces facing the associated turbine vanes 44. The second side surfaces S2 and S2' of the shield plate 100 are defined as side surfaces facing each other in the circumferential direction (i.e., x-axis direction) of the turbine 40, that is, side surfaces facing adjacent ring segments 1000 when a plurality of ring segments 100 are arranged adjacently in the circumferential direction (i.e., x-axis direction) of the turbine 40 to form a ring shape. In this case, the second side surfaces S2 and S2' of the adjacent ring segments 1000 face each other with a predetermined gap.

For example, as illustrated in FIGS. 3 and 4, the first cooling passages 300 connect the cavity C to the facing first side surfaces S1 and S1' of the shield plate 100. The first cooling passages 300 extend in the longitudinal direction (i.e., y-axis direction) of the central axis of the turbine 40 and are spaced apart from each other in the circumferential direction (i.e., x-axis direction) of the turbine 40.

Each of the first cooling passages 300 has an inlet 320 formed in a lower inner surface of an associated one of the first and second hooks 210 and 220, and an outlet 330 formed in an associated one of the first side surfaces S1 and S1' of the shield plate 100. Accordingly, the cooling air flowing into the cavity C may be sprayed to the first side surfaces S1 and S1' of the shield plate 100 through the first cooling passages 300.

As illustrated in FIGS. 3 and 5, the second cooling passages 400 extend in a direction perpendicular to the first cooling passages 300 to intersect with the first cooling passages 300 and connect the cavity C to the facing second side surfaces S2 and S2' of the shield plate 100. The second cooling passages 400 extend in the circumferential direction (i.e., x-axis direction) of the turbine 40 and are spaced apart from each other in the longitudinal direction (i.e., y-axis direction) of the central axis of the turbine 40.

Each of the second cooling passages 400 has an inlet 420 formed in an inner surface of an associated one of the reinforcing parts 120 and an outlet 430 formed in an associated one of the second side surfaces S2 and S2' of the shield plate 100. Accordingly, the cooling air flowing into the cavity C may be sprayed to the second side surfaces S2 and S2' of the shield plate 100 through the second cooling passages 400.

In this case, a chamber 410 for connecting the plurality of second cooling passages 400 is provided between the inlets 420 and the outlets 430 of the second cooling passages 400. That is, the chamber 410 is formed inside the shield plate 100, and each of the plurality of second cooling passages 400 has the inlet 420 connected from the cavity C to the chamber 410 and the outlet 430 connected from the chamber 410 to the second side surface S2 or S2' of the shield plate 100.

The chamber 410 extends in the longitudinal direction (i.e., y-axis direction) of the central axis of the turbine 40, that is, from the first hook 210 to the second hook 220, inside the shield plate 100. Here, the chamber 410 is formed between the first hook 210 and the second hook 220. In addition, because the chamber 410 is formed in the circumferential direction (i.e., x-axis direction) of the turbine 40 at both side ends of the shield plate 100, the first cooling passages 300 are between the two chambers 410 and do not communicate with the chambers 410.

Accordingly, the cooling air flowing into the cavity C is introduced into the second cooling passages 400 through the inlets 420, joins in the chambers 410, and is then discharged again to the second side surfaces S2 and S2' of the shield plate 100 through the outlets 430. In this way, the cooling air introduced into the second cooling passages 400 joins in the chambers 410 and is then distributed again, so that the residence time of the cooling air in the shield plate 100 increases, thereby improving the cooling efficiency of the ring segment. In addition, when cooling air is introduced into the chambers 410 through the inlets 420, cooling efficiency can be further improved because the cooling air strikes the inner walls of the chambers 410. In order to increase the residence time of the cooling air in each chamber 410, it is preferable that the inlet 420 of each second cooling passages is connected to an upper side of the chamber 410 and the outlet 430 is connected to a lower side of the chamber 410. However, it is understood that the disclosure is not limited thereto.

As a result, the cooling air in each ring segment 1000 may be discharged to the first side surfaces S1 and S1' facing the associated turbine vanes 44 through the first cooling passages 300, and discharged to the second side surfaces S2 and S2' facing adjacent ring segments 1000 through the second cooling passages 400. In this way, the air discharged through the second cooling passages 400 strikes the second side surfaces S2 and S2' of the adjacent ring segments 1000 to cool them and flows toward the inside of the turbine casing 14, thereby forming an air curtain between the adjacent ring segments 1000. Therefore, it is possible to block the inflow of high-temperature and high-pressure combustion gas between the adjacent ring segments 1000.

According to the first exemplary embodiment, in order for the cooling air discharged through the second cooling passages 400 to more effectively form the air curtain between the adjacent ring segments 1000, the outlet 430 of each second cooling passages 400 is formed obliquely toward the inside of the turbine casing 14. The outlet 430 of the second cooling passage 400 is preferably inclined at an angle of 30° to 60°. This is to apply a force to the cooling air to be discharged inward to reliably block the inflow of high-temperature and high-pressure combustion gas between the adjacent ring segments 1000, while striking the side surfaces of the adjacent ring segments 1000 to cool them.

In one or more exemplary embodiments, the outlet 430 of the second cooling passage 400 may have a structure in which an inner diameter gradually decreases from the inside to the outside of the ring segment 1000. Accordingly, because a velocity of the air sprayed from the outlets 430 of the second cooling passages 400 is increased, it is possible to reliably block the inflow of high-temperature and high-pressure combustion gas between the adjacent ring segments 1000.

As such, the ring segment 1000 having the first cooling passages 300, the second cooling passages 400, and the chambers 410 therein may be formed by additive manufacturing.

Although the first exemplary embodiment has been described that the second cooling passages 400 are formed to connect the cavity C and the two facing second side surfaces S2 and S2' of the shield plate 100, the disclosure is not limited thereto. For example, the second cooling passages 400 may also be formed to connect the cavity C and only one second side surface S2 located in the direction of rotation of the turbine blade 42 (i.e., in a negative x-axis direction). In this case, air is discharged through the second cooling passages 400 only in the direction of rotation of the turbine blade 42 from the side surface of the ring segment 1000 directed in the same direction as a tip of the turbine blade 42. For this reason, because cooling air is discharged only in the rotational direction of the turbine blade 42, although the amount of discharged cooling air is less than when the second cooling passages 400 are formed at both side ends of the ring segment 1000, it is possible to perform stable cooling without disturbance by the flow of the combustion gas flowing out from the turbine blade 42. Further, the side end of the ring segment 1000 in which the second cooling passages 400 are not formed may also be cooled by cooling air discharged from the second cooling passages of an adjacent ring segment.

FIG. 6 is a cross-sectional view illustrating a ring segment 2000 according to a second exemplary embodiment.

Because the ring segment 2000 according to the second exemplary embodiment has the same structure as the ring segment 1000 according to the first exemplary embodiment except for a chamber structure, a redundant description of the same configuration will be omitted.

Referring to FIG. 6, each second cooling passages 2400 connects a cavity C to an associated one of second side surfaces S2 and S2' of a shield plate 2100 facing each other, and includes an inlet 2420 formed in an inner surface of an associated reinforcing part 2120 and an outlet 2430 formed in the associated second side surface S2 or S2'. A chamber 2410 for connecting the plurality of second cooling passages 2400 is defined between the inlets 2420 and the outlets 2430 thereof. In the exemplary embodiment, the chamber 2410 is elongated from the inside of the shield plate 2100 to the inside of the reinforcing part 2120. Accordingly, a heat transfer area of the ring segment may be expanded and the residence time of the cooling air in the chamber 2410 may be increased.

In addition, the chamber 2410 may include at least one partition wall 2440, and only one end thereof is fixed to the inner surface of the chamber 2410 to induce a direction change of cooling air. If a plurality of partition walls 2440 are provided in the chamber 2410, the partition walls 2440 adjacent to each other are preferably configured such that their fixed ends fixed to the inner surface of the chamber 2410 are positioned in opposite directions so that cooling air may flow in a serpentine form in the chamber 2410. That is, above and below the fixed end of one partition wall 2440 fixed to the inner surface of the chamber 2410, the free ends of adjacent partition walls 2440 are positioned.

Although two partition walls 2440 are provided in the exemplary embodiment, the disclosure is not limited thereto. The two partition walls 2440 extend in the circumferential direction (i.e., x-axis direction) of the turbine 40 and are spaced apart from each other in the radial direction (i.e., z-axis direction) of the turbine 40, that is, in a height direction of the chamber 2410. The partition wall 2440 disposed at a top is fixed to one surface of the chamber 2410, and the partition wall 2440 disposed at the bottom is fixed to the other surface of the chamber 2410 facing one surface of the chamber 2410. Thus, the cooling air in the chamber 2410 is induced to flow in a serpentine form as indicated by a dotted line. Accordingly, it is possible to improve the cooling efficiency of the ring segment because the cooling air strikes the partition walls 2440 and the residence time of the cooling air is increased.

According to the exemplary embodiment, in order for the cooling air discharged through the second cooling passages 2400 to more effectively form an air curtain between adjacent ring segments 2000, the outlet 2430 of each second cooling passages 2400 is formed obliquely toward the inside of the turbine casing 14.

FIG. 7 is a cross-sectional view illustrating a ring segment 3000 according to a third exemplary embodiment.

Because the ring segment 3000 according to the third exemplary embodiment has the same structure as the ring segment 2000 according to the second exemplary embodiment except for a structure of a chamber partition wall and an outlet, a redundant description of the same configuration will be omitted.

Referring to FIG. 7, each second cooling passages 3400 connects a cavity C to an associated one of second side surfaces S2 and S2' of a shield plate 3100 facing each other, and includes an inlet 3420 formed in an inner surface of an associated reinforcing part 3120 and an outlet 3430 formed in the associated second side surface S2 or S2'. A chamber 3410 for connecting the plurality of second cooling passages 3400 is defined between the inlets 3420 and the outlets 3430 thereof. The chamber 3410 is elongated from the inside of the shield plate 3100 to the inside of the reinforcing part 3120.

In addition, the chamber 3410 may include at least one partition wall 3440, and only one end thereof is fixed to the inner surface of the chamber 3410 to induce a direction change of cooling air. If a plurality of partition walls 3440 are provided in the chamber 3410, the partition walls 3440 adjacent to each other are preferably configured such that their fixed ends fixed to the inner surface of the chamber 3410 are positioned in opposite directions so that cooling air may flow in a serpentine form in the chamber 3410.

Although one partition wall 3440 is provided in the exemplary embodiment, the disclosure is not limited thereto. For example, two or more partition walls 3440 may be provided. One partition wall 3440 extends in the radial direction (i.e., z-axis direction) of the turbine 40, that is, in a height direction of the chamber 3410, and is fixed to an upper inner surface of the chamber 3410. Accordingly, the cooling air in the chamber 3410 is induced to flow in a serpentine form as indicated by a dotted line.

Here, because the cooling air introduced from an upper side of the chamber 3410 through the inlets 3420 of the second cooling passages 3400 flows to a lower side of the chamber 3410 by the partition wall 3440 and then flows upward by changing the direction thereof, it is preferable that the outlet 3430 of each second cooling passages 3400 is formed in the upper side of the chamber 3410.

According to the exemplary embodiment, in order for the cooling air discharged through the second cooling passages 3400 to more effectively form an air curtain between adjacent ring segments 3000, the outlet 3430 of each second cooling passages 3400 is formed obliquely toward the inside of the turbine casing 14. In this case, when the outlet 3430 of the second cooling passage 3400 is formed in the upper side of the chamber 3410, the range in which the outlet 3430 may be formed is larger than when the outlet 3430 is formed in the lower side of the chamber 3410, so that the inclined angle and length of the outlet 3430 may be easily set.

FIG. 8 is a perspective view illustrating a ring segment 4000 according to a fourth exemplary embodiment.

Because the ring segment 4000 according to the fourth exemplary embodiment has the same structure as the ring segment 1000 according to the first exemplary embodiment except for a structure of an additional cooling passage and an additional outlet, a redundant description of the same configuration will be omitted.

Referring to FIG. 8, each second cooling passage 4400 connects a cavity C to an associated one of second side surfaces S2 and S2' of a shield plate 4100 facing each other, and includes an inlet 4420 formed in an inner surface of an associated reinforcing part 4120 and an outlet 4430 formed in the associated second side surface S2 or S2'. A chamber 4410 for connecting the plurality of second cooling passages is defined between the inlets 4420 and the outlets 4430 thereof.

The chamber 4410 extends in the longitudinal direction (i.e., y-axis direction) of the central axis of the turbine 40 and is formed between a first hook 4210 and a second hook 4220 in the shield plate 4100. This is because, if the chamber is formed in areas of the hooks, the rigidities of the hooks for fastening the ring segment to the turbine casing may be reduced. In this regard, the exemplary embodiment is aimed at spraying cooling air from the second side surfaces S2 and S2' of the ring segment while maintaining the rigidity of the hook, and is intended to allow the cooling air to be sprayed from the entirety of the second side surfaces rather than only between the first hook 4210 and the second hook 4220.

To this end, the ring segment 4000 according to the exemplary embodiment further includes additional cooling passages 4450 and additional outlets 4460. The additional cooling passages 4450 are connected to both ends of the chamber 4410 and extend in the longitudinal direction (i.e., y-axis direction) of the central axis of the turbine 40. Accordingly, the cooling air in the chamber 4410 may be distributed to both the outlets 4430 as well as the additional cooling passages 4450. In some exemplary embodiments, each additional cooling passages 4450 may have a structure in which an inner diameter gradually decreases from one end thereof connected to the chamber 4410 to the other end thereof. Accordingly, cooling air can be effectively distributed to flow to a portion of the additional cooling passages 4450 far from the chamber 4410.

Each of the additional cooling passages 4450 may be provided with a plurality of additional outlets 4460 for connecting the additional cooling passage 4450 to an associated one of the second side surfaces S2 and S2' of the shield plate 4100.

The additional outlets 4460 may be spaced apart from each other in the longitudinal direction (i.e., y-axis direction) of the central axis of the turbine 40. The additional outlets 4460 may extend from the additional cooling passage 4450 in the circumferential direction (i.e., x-axis direction) of the turbine 40. As with the outlets 4430, the additional outlets 4460 may be formed obliquely toward the inside of the turbine casing 14. In this case, to maintain the rigidity of each hook, no additional outlet 4460 may be formed in a portion in which the first and second hooks 4210 and 4220 are formed.

Accordingly, because cooling air is widely sprayed from the second side surfaces S2 and S2' of the ring segment in the longitudinal direction (i.e., y-axis direction) of the ring segment, the cooling efficiency of the ring segment can be enhanced. In addition, because the range in which an air curtain is formed between adjacent ring segments 4000 increases, it is possible to reliably block the inflow of combustion gas therebetween.

Although the fourth exemplary embodiment has been described that the additional cooling passages are connected to the chamber, the disclosure is not limited thereto. For example, a separate additional chamber may be connected to the chamber as illustrated in FIG. 9. FIG. 9 is a perspective view illustrating a ring segment 5000 according to a fifth exemplary embodiment.

Referring to FIG. 9, each second cooling passages of the ring segment 5000 connects a cavity C to an associated one of second side surfaces S2 and S2' of a shield plate 5100 facing each other, and includes an inlet 5420 and an outlet 5430. A chamber 5410 for connecting the plurality of second cooling passages is formed between the inlets 5420 and the outlets 5430 thereof. The chamber 5410 extends in the longitudinal direction (i.e., y-axis direction) of the central axis of the turbine 40 and is formed between a first hook 5210 and a second hook 5220*n* the shield plate 5100.

The exemplary embodiment further includes addition cooling passages 5450, additional chambers 5470, and additional outlets 5460 such that cooling air is sprayed from the entirety of the second side surfaces S2 and S2' of the ring segment while maintaining the rigidities of the hooks.

The additional cooling passages 5450 are connected to both ends of the chamber 5410 and extend in the longitudinal direction (i.e., y-axis direction) of the central axis of the turbine 40. Accordingly, the cooling air in the chamber 5410 may be distributed to both the outlets 5430 as well as the additional cooling passages 5450. In addition, the additional chambers 5470 may be connected to both the additional cooling passages 5450, respectively. Here, the additional cooling passages 5450 extend to a range in which the hooks protrude in the shield plate 5100, and the additional chambers 5470 are provided at both ends of the shield plate 5100 from which the hooks do not protrude. This is because, when the chambers are formed in areas of the hooks, the rigidities of the hooks for fastening the ring segment to the turbine casing may be reduced. In this case, the additional chambers 5470 may have the same shape and structure as the chamber 5410, but the disclosure is not limited thereto. The additional chambers 5470 may have different shapes and structures.

Each of the additional chambers 5470 may be provided with a plurality of additional outlets 5460 for connecting the additional chamber 5470 to an associated one of the second side surfaces S2 and S2' of the shield plate. The additional outlets 5460 may be spaced apart from each other in the longitudinal direction (i.e., y-axis direction) of the central axis of the turbine 40. As with the outlets 5430, the additional outlets 5460 may be formed obliquely toward the inside of the turbine casing 14.

Accordingly, cooling air can be widely sprayed from the second side surfaces S2 and S2' of the ring segment in the longitudinal direction (i.e., y-axis direction) of the ring segment. Here, because the residence time of the cooling air is increased even at both ends of the ring segment by provision of the additional chambers 5470, the cooling efficiency of the ring segment can be further enhanced.

In the ring segment according to the exemplary embodiments, the outlet of each second cooling passage formed in one surface S2 of the two facing second side surfaces S2 and S2' of the ring segment and the outlet of each second cooling passage formed in the other surface S2' of the two facing second side surfaces S2 and S2' may be formed at different positions. For example, it is preferable that the outlets of the second cooling passages are formed such that the cooling air sprayed from the second side surface S2 of one ring segment of adjacent ring segments may be offset from the cooling air sprayed from the second side surface S2' of the other ring segment facing the second side surface S2. For example, the outlets of the second cooling passage formed on one second side surface S2 of the ring segment and the outlets of the second cooling passages formed on the other second side surface S2' may be arranged in a staggered form. Accordingly, the cooling air sprayed between adjacent ring segments can effectively form an air curtain without being disturbed due to collisions.

In addition, in the ring segment according to the exemplary embodiments, the number of outlets formed in one surface S2, positioned forward in the rotational direction of the turbine blade 42, of the two facing second side surfaces S2 and S2' of the shield plate may be greater than the number of outlets formed on the other surface S2', positioned rearward in the rotational direction of the turbine blade 42, of the two facing second side surfaces S2 and S2'. Accordingly, in each ring segment, the amount of cooling air discharged from the second side surface S2 positioned forward in the rotational direction of the turbine blade 42 is more than the amount of cooling air discharged from the second side surface S2' positioned rearward in the rotational direction of the turbine blade 42. This is because, when cooling air is discharged in a direction opposite to the rotational direction of the turbine blade 42, the outlet flow of the cooling air may be disturbed by the flow of combustion gas having a rotational momentum flowing out from the turbine blade 42. Therefore, by discharging in a greater amount the cooling air supplied to the cavity C through the second side surface S2 from which the cooling air is discharged in the same direction as the rotational direction of the turbine blade 42 in the ring segment, it is possible to reduce the disturbance of the flow of the cooling air due to the flow of combustion gas and to perform stable cooling.

Although the outlets of each second cooling passages are illustrated as being formed in a straight line, they may be formed in a curved line.

According to the exemplary embodiments, because the cooling efficiency of the ring segment is improved, it is possible to prevent the ring segment from breaking by thermal load. In addition, by generating an air curtain between adjacent ring segments, it is possible to efficiently prevent the leakage of high-temperature and high-pressure combustion gas in the turbine.

Ultimately, the efficiency of the gas turbine can be enhanced.

According to the exemplary embodiments, the ring segment is simultaneously provided with the first cooling passages that allow cooling air to be sprayed from the cavity to the facing first side surfaces and the second cooling passages that allow cooling air to be sprayed from the cavity to the facing second side surfaces, and the plurality of second cooling passages are connected to each other by the chamber. Therefore, because the cooling efficiency of the ring segment is improved, it is possible to prevent the ring segment from breaking by thermal load.

In addition, by generating an air curtain between adjacent ring segments, it is possible to efficiently prevent the leakage of high-temperature and high-pressure combustion gas in the turbine.

Ultimately, the efficiency of the gas turbine can be enhanced.

While exemplary embodiments have been described with reference to the accompanying drawings, it will be apparent to those skilled in the art that various modifications in form and details may be made therein without departing from the spirit and scope as defined in the appended claims. Therefore, the description of the exemplary embodiments should be construed in a descriptive sense and not to limit the scope of the claims, and many alternatives, modifications, and variations will be apparent to those skilled in the art.

What is claimed is:

1. A ring segment comprising:

a shield plate mounted to a casing which accommodates a turbine and configured to face an inner wall of the casing;

a pair of hooks configured to protrude from the shield plate toward the casing to be coupled to the casing, the pair of hooks and the shield plate being integrally formed;

a pair of reinforcing parts configured to protrude from the shield plate to connect the pair of hooks;

a cavity defined by surrounding the shield plate, the pair of hooks and the pair of reinforcing parts;

a plurality of first cooling passages configured to connect the cavity and first side surfaces facing each other of the shield plate; and a plurality of second cooling passages configured to connect the cavity and second side surfaces facing each other of the shield plate, wherein the first cooling passages extend in a longitudinal direction of a central axis of the turbine, and the second cooling passages extend in a circumferential direction of the turbine, wherein each of the second cooling passages comprises an inlet formed in an inner surface of each of the reinforcing parts and an outlet formed in each of the second side surfaces of the shield plate.

2. The ring segment according to claim 1, wherein the shield plate includes chambers defined therein, and each of the second cooling passages comprises the inlet connected to an associated one of the chambers from the cavity and the outlet connected to an associated one of the second side surfaces of the shield plate from the associated chamber.

3. The ring segment according to claim 2, wherein the chambers extend in the longitudinal direction of the central axis of the turbine between the pair of hooks.

4. The ring segment according to claim 3, wherein the chambers are formed in respective second side ends facing each other of the shield plate.

5. The ring segment according to claim 2, wherein the outlet is inclined radially inward of the turbine.

6. The ring segment according to claim 5, wherein the outlet is inclined at an angle of 20° to 60°.

7. The ring segment according to claim 2, further comprising a plurality of additional cooling passages configured to be connected to both ends of each of the chambers and extend in the longitudinal direction of the central axis of the turbine.

8. The ring segment according to claim 7, further comprising a plurality of additional outlets configured to connect each of the additional cooling passages and an associated one of the second side surfaces of the shield plate.

9. The ring segment according to claim 8, wherein the additional outlets are spaced apart from each other in the longitudinal direction of the central axis of the turbine, and are arranged in a portion excluding portions in which the pair of hooks are formed in the shield plate.

10. The ring segment according to claim 7, wherein each of the additional cooling passages is connected to an additional chamber.

11. The ring segment according to claim 10, further comprising a plurality of additional outlets configured to connect the additional chamber and an associated one of the second side surfaces of the shield plate.

12. The ring segment according to claim 11, wherein the additional chamber is formed in a portion excluding portions in which the pair of hooks are formed in the shield plate.

13. The ring segment according to claim 1, wherein chambers for connecting the plurality of second cooling passages are defined between the inlets and the outlets, each of the chambers being elongated from inside of the shield plate to inside of each of the reinforcing parts, and each of the second cooling passages comprises the inlet connected to an associated one of the chambers from the cavity and the outlet connected to an associated one of the second side surfaces of the shield plate from the associated chamber.

14. The ring segment according to claim 13, wherein the outlets formed in one of the facing second side surfaces of the shield plate and the outlets formed in the other of the facing second side surfaces are arranged in a staggered form.

15. The ring segment according to claim 13, wherein a number of outlets formed in one surface, positioned forward in a rotational direction of the turbine, of the facing second side surfaces of the shield plate is greater than a number of outlets formed in the other surface, positioned rearward in the rotational direction of the turbine, of the facing second side surfaces.

16. The ring segment according to claim 13, wherein each of the chambers is provided therein with a partition wall having one end fixed to an upper inner surface of the chamber, and the inlet and the outlet are connected to an upper side of the chamber.

17. A turbine comprising:

a turbine casing;

a rotatable turbine rotor disk disposed in the turbine casing;

a plurality of turbine blades installed on the turbine rotor disk;

a plurality of turbine vanes installed in the turbine casing; and a plurality of ring segments mounted to the turbine casing to surround the turbine blades, wherein the ring segments are arranged adjacently and continuously m a circumferential direction of the turbine casing to form a ring shape, wherein each of the ring segments comprises:

a shield plate configured to face an inner wall of the turbine casing;

a pair of hooks configured to protrude from the shield plate toward the casing to be coupled to the casing, the pair of hooks and the shield plate being integrally formed;

a pair of reinforcing parts configured to protrude from the shield plate to connect the pair of hooks;

a cavity defined by surrounding the shield plate, the pair of hooks and the pair of reinforcing parts;

a plurality of first cooling passages configured to connect the cavity and first side surfaces facing each other of the shield plate; and a plurality of second cooling passages configured to connect the cavity and second side surfaces facing each other of the shield plate, and wherein the first side surfaces face the turbine vanes, and the second side surfaces face adjacent ring segments, wherein each of the second cooling passages comprises an inlet formed in an inner surface of each of the reinforcing parts and an outlet formed in each of the second side surfaces of the shield plate.

18. The turbine according to claim 17, wherein cooling air sprayed from one ring segment is offset from cooling air sprayed theretoward from an adjacent ring segment.

19. The turbine according to claim 17, wherein in each of the ring segments, an amount of cooling air discharged from a second side surface positioned forward in a rotational direction of the turbine blades is greater than an amount of cooling air discharged from a second side surface positioned rearward in the rotational direction of the turbine blades.

20. A gas turbine comprising:

a compressor configured to compress air introduced from an outside;

a combustor configured to mix fuel with the air compressed by the compressor and burn a mixture thereof to produce high-temperature and high-pressure combustion gas;

a turbine configured to generate a rotational force using the combustion gas discharged from the combustor; and a casing in which the compressor, the combustor, and the turbine are accommodated, wherein the turbine comprises:

a rotatable turbine rotor disk disposed in the casing;

a plurality of turbine blades installed on the turbine rotor disk;

a plurality of turbine vanes installed in the casing; and a plurality of ring segments mounted to the casing to surround the turbine blades, wherein the ring segments are arranged adjacently and continuously m a circumferential direction of the casing to form a ring shape, wherein each of the ring segments comprises:

a shield plate configured to face an inner wall of the turbine casing;

a pair of hooks configured to protrude from the shield plate toward the casing to be coupled to the casing, the pair of hooks and the shield plate being integrally formed;

a pair of reinforcing parts configured to protrude from the shield plate to connect the pair of hooks;

a cavity defined by surrounding the shield plate, the pair of hooks and the pair of reinforcing parts;

a plurality of first cooling passages configured to connect the cavity and first side surfaces facing each other of the shield plate; and a plurality of second cooling passages configured to connect the cavity and second side surfaces facing each other of the shield plate, and wherein the first side surfaces face the turbine vanes, and the second side surfaces face adjacent ring segments, wherein each of the second cooling passages comprises an inlet formed in an inner surface of each of the reinforcing parts and an outlet formed in each of the second side surfaces of the shield plate.

* * * * *